US005787984A

United States Patent [19]

Mabile

[11] Patent Number: 5,787,984

[45] Date of Patent: Aug. 4, 1998

[54] METHOD AND DEVICE FOR CASING A WELL WITH A COMPOSITE PIPE

[75] Inventor: Claude Mabile, Clamart, France

[73] Assignee: Institut Francais du Petrole, Rueil Malmaison, France

[21] Appl. No.: 662,213

[22] Filed: Jun. 12, 1996

[30] Foreign Application Priority Data

Jun. 13, 1995 [FR] France ..... 95 07121

[51] Int. Cl.[6] ..... E21B 23/00

[52] U.S. Cl. ..... 166/277; 166/207

[58] Field of Search ..... 166/380, 55.7, 166/55.8, 207, 212, 277

[56] References Cited

U.S. PATENT DOCUMENTS

| | | | |
|---|---|---|---|
| 1,358,818 | 11/1920 | Bering . | |
| 2,812,025 | 11/1957 | Teague et al. | 166/207 |
| 2,991,834 | 7/1961 | Kennard . | |
| 3,104,703 | 9/1963 | Rike et al. | 166/207 X |
| 3,358,769 | 12/1967 | Berry . | |
| 3,419,080 | 12/1968 | Lebourg | 166/207 |
| 3,477,506 | 11/1969 | Malone | 166/207 |
| 5,031,699 | 7/1991 | Artunov et al. | 166/207 |
| 5,366,012 | 11/1994 | Lohbeck | 166/207 X |

FOREIGN PATENT DOCUMENTS

| | | |
|---|---|---|
| 2 662 207 | 11/1991 | France . |
| 2 668 241 | 4/1992 | France . |
| 94/29382 | 9/1993 | WIPO . |
| 94/21887 | 9/1994 | WIPO . |
| 94/25655 | 11/1994 | WIPO . |

*Primary Examiner*—William P. Neuder
*Attorney, Agent, or Firm*—Millen, White, Zelano & Branigan, P.C.

[57] ABSTRACT

The present invention relates to a method for casing a well (1) from a tubular preform (2) lowered into a well in folded state. The preform comprises seal means (3, 4) at both ends so that it can be inflated in order to take on a second, unfolded state in which the preform is polymerized.

Means (30) for disconnecting lower seal means (3) in order to take the latter up to the surface in a receptacle (11) are inserted into the casing.

The invention also relates to a casing device comprising disconnecting means (30) and a receptacle (11) for the lower seal means (3).

FIG. 1 to be published.

13 Claims, 4 Drawing Sheets

METHOD AND DEVICE FOR CASING A WELL WITH A COMPOSITE PIPE

FIELD OF THE INVENTION

The present invention describes a process and a device for casing a well drilled ground from a folded preform comprising seal means at both ends. The preform is lowered into the well, then it is inflated by a fluid pumped into the inner space of the preform so that it unfolds and that it takes on a substantially tubular shape prior to hardening in the well. According to the invention, the lower seal means are disconnected and taken up to the surface through the inner channel of the composite casing. Thus, the lower part of the casing is cleared so as to allow operations in the composite casing, for example in order to deepen the borehole.

BACKGROUND OF THE INVENTION

Documents WO 94/25,655 and WO 94/21,887 describe processes for casing wells from a composite preform inflated by means of a sleeve (or die) placed inside the preform. After polymerization of the preform, the sleeve is removed from the cased well by exerting a traction on the end thereof, from the ground surface. Such a system is not suitable for composite casings of great length since it is not possible, in this case, to remove the sleeve. Furthermore, it is not possible to insert a sleeve of great length into a non polymerized preform.

SUMMARY OF THE INVENTION

The present invention thus relates to a method for casing a well from a tubular preform that is radially deformable by inflation between a folded state in which its greatest transverse dimension is smaller than the diameter of the well, and another, unfolded state in which said preform has a substantially cylindrical shape, said preform comprising seal means at both ends, the preform being hardenable in the well so as to constitute said casing. The method comprises the following stages:

means for disconnecting the seal means situated at the lower end of the preform are inserted into the inner space of the preform, said seal means are taken up to the ground surface after being placed in a receptacle whose transverse dimension is smaller than the inside diameter of the preform once it has hardened.

The receptacle can be fastened to said lower seal means.

The seal means at the upper end of the preform can be disconnected first once the preform has hardened.

The disconnecting means can be lowered into the preform by means of rods.

The disconnecting means can be activated by the rotation of the rods and/or by a pressurized fluid contained in the rods.

The invention relates to a device for casing a well from a tubular preform that is radially deformable by inflation between a folded state in which its greatest transverse dimension is smaller than the diameter of the well, and another, unfolded state in which said preform has a substantially cylindrical shape, said preform comprising seal means at both ends, the preform being hardenable in the well so as to constitute said casing. Said device comprises means for disconnecting said lower seal means, a receptacle in which said seal means are placed after disconnection, a receptacle whose transverse dimension is smaller than the inside diameter of the preform once it has hardened.

In the device, the receptacle can be fastened to the end of said lower seal means, the latter comprising a seat and an orifice.

A measuring assembly can be fastened to the lower seal means with the aid of said seat, said assembly sealing the orifice.

The measuring assembly can be connected to the ground surface by conductors incorporated in the preform.

The disconnecting means can comprise a rod passing through said orifice so as to latch said receptacle, cutting means positioned with respect to the lower seal means with the aid of said seat, said cutting means being activated through at least one of the following actions: rotation, compression on the disconnecting means, pressure of a fluid.

The measuring assembly can comprise detectors suited for locating the lower end of the preform in the well.

The disconnecting means can comprise means for delivering a pressurized fluid.

BRIEF DESCRIPTION OF THE DRAWINGS

Other features and advantages of the present invention will be clear from reading the description hereafter, given by way of non limitative examples, with reference to the accompanying drawings in which.

DESCRIPTION OF THE PREFERRED EMBODIMENTS

Figure 1:
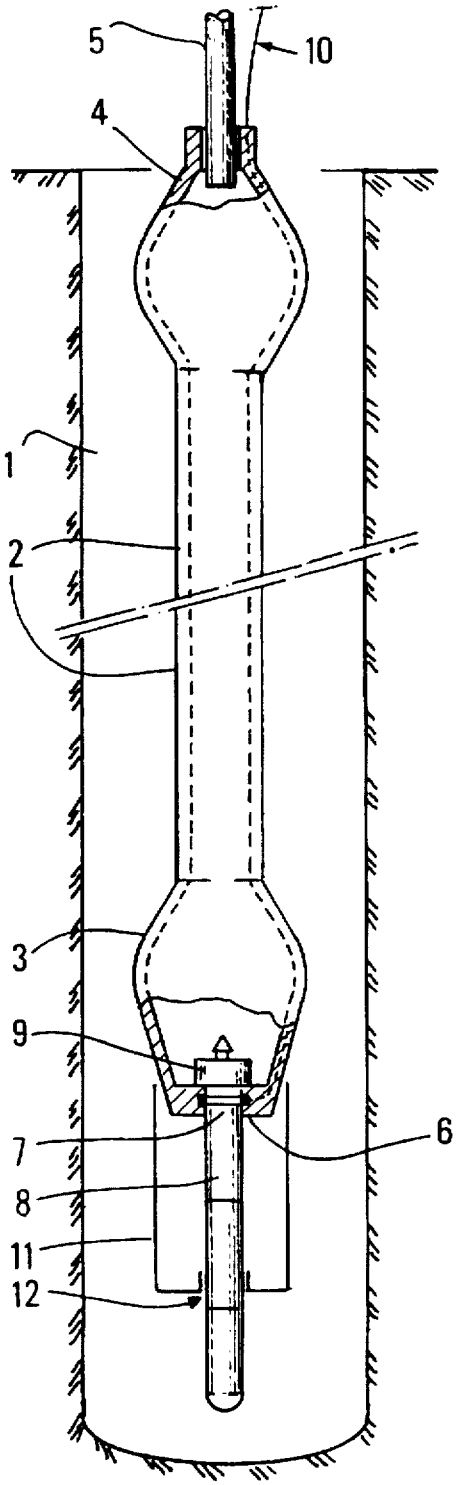
FIG. 1 shows the principle of setting a preform in a well.

FIG. 1 shows the lowering into a well 1 of a supple and hardenable preform 2 set in folded state (a state in which it exhibits a small radial dimension), then radially unfolded by applying an inside pressure. This technique is described in documents FR-A-2,662,207, FR-A-2,668,241, WO 94/25,655 or WO 94/21,887. This preform comprises a composite structure made of resin-impregnated reinforcing fibers. In order to carry out the inflation operation allowing to unfold the preform, the latter is equipped with seal means at both ends, referenced 3 for those situated at the lower end and 4 for those situated at the upper end. The wall of the preform comprises at least one seal coat. The reinforcing fibers of the preform are secured to the two seal means 3 and 4 so as to withstand the stresses generated by the inside pressure. A pipe 5 is connected to the preform so as to allow the setting thereof in the well and to deliver a pressurized fluid into the inner space of the preform. The lower seal means 3 comprise a seat 6 and an orifice 7 in lowered position. A measuring device 8 is preferably positioned in orifice 7, on seat 6. The function of the supporting head 9 of the measuring device is to reversibly connect device 8 to the end of the preform, to allow device 8 to be taken up to the surface by means of a suitable fishing tool, to establish at least one electric connection between the measuring detectors of device 8 with cable 10 by means of conducting wires integrated in the preform at the time of its manufacturing. Thus, during the lowering of the preform in the well to be cased, the detectors of device 8 supply adequate information for controlling the correct setting of the preform in the well. In fact, the preform is supple since the resin is not polymerized, which does not facilitate the lowering thereof into the well. In order to facilitate this setting, load bars can be added to device 8 so as to maintain at best the preform under tension despite frictions on the wall of the well.

The detectors of device 8 can be any types of devices allowing geographic locating, or deepening measurement as a function of the pressure or temperature gradient. Temperature indicators can also be used to control the following polymerization operation.

A receptacle 11 is fastened below means 3. The main function of receptacle 11 is described hereafter. The bottom of receptacle 11 comprises an orifice 12 allowing at least part of device 8 to run through the preform. The function of orifice 12 is also to allow the receptacle to be implemented.

Figure 2A:
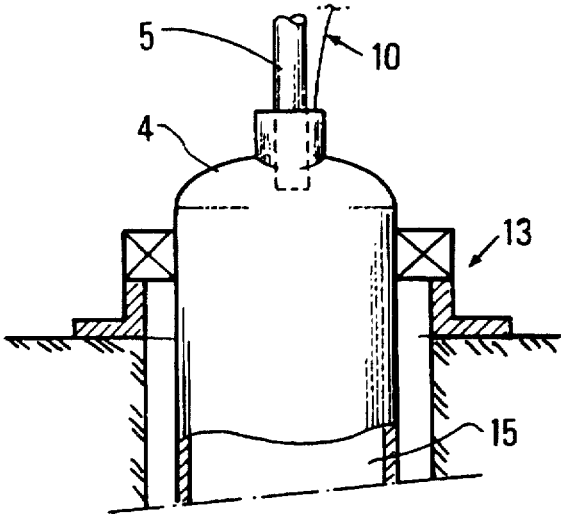
FIGS. 2A and 2B show the upper seal means in two implementation variants.
Figure 2B:
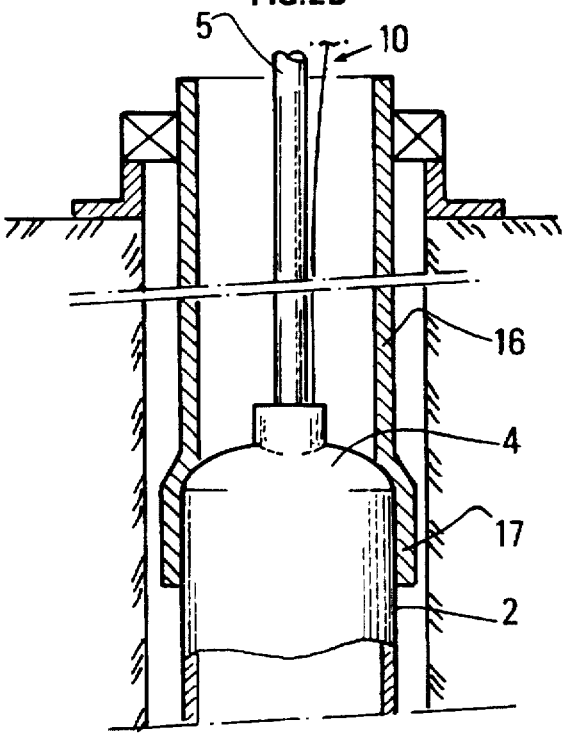

FIGS. 2A and 2B show the position of seal means 4 with respect to the well, in two different variants:

In FIG. 2A, preform 2 covers a well height up to the ground surface, which allows direct access to the upper seal means 4. In this case, after inflation and preferably hardening of the preform, the latter is suspended from wellhead elements 13 resting on the ground. After hardening of the preform, means 4 are cut so as to facilitate operations of suspension from elements 13 and to have access to the inner space 15 of the composite casing in order to carry on operations.

In FIG. 2B, preform 2 is destined to case a well length between the bottom and the lower end of a previous casing 16 already in place. This casing 16 can stem from the same composite casing technology, but it can also be a conventional steel or composite casing. The lower end of casing 16 advantageously ends in a radial widening 17 so that the casinghead 4 fits into this widening as shown in FIG. 2B. Thus, there can be no diameter reduction of the passage between casing 16 and the casing constituted by preform 2. Preform 2, in the folded state, thus before polymerization, is lowered by means of tubes 5 connected to the upper seal means 4. After the polymerization of preform 2, means 4 are detached, either by tearing off by pulling on tubes 5 from the surface, or by cutting means that can be lowered at the end of tubes 5 at the same time as the preform, or after polymerization, which requires an additional manoeuvre with tubes 5. The means for cutting means 4 can be lowered and run through an orifice of means 4, or set in means 4 when they are manufactured.

According to the embodiment of FIG. 2B, conductors 10 are situated in the annulus between tubes 5 and casing 16.

Figure 3:
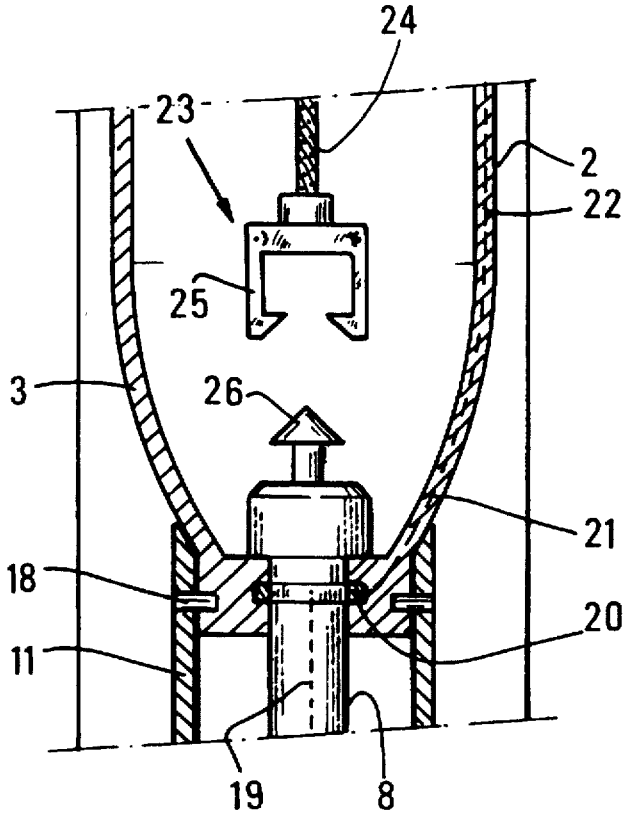
FIG. 3 shows the lower seal means after or during the hardening of the casing.

FIG. 3 shows the lower seal means 3 equipped with the receptacle 11 connected to means 3, for example by fastening elements 18 that can be sheared under a determined stress. Conductors 19 connected to the measuring detectors of device 8 are continuously connected to the ground surface with the aid of connection means 20 (between the head of device 8 and the seat of means 3), of conductors 21 included in means 3, of conductors 22 incorporated during the manufacture of the preform, and of cable 10 described above. FIG. 3 shows a tool 23, for example of the "wireline" type, consisting of an operating line 24 (or equivalent) lowered into the casing, a fishing head 25 suited to a supplementary part 26 fastened to the top of device 8. Once device 8 has been taken up, the means for disconnecting lower seal means 3 can be lowered into casing 2 according to the present invention.

Figure 4A:
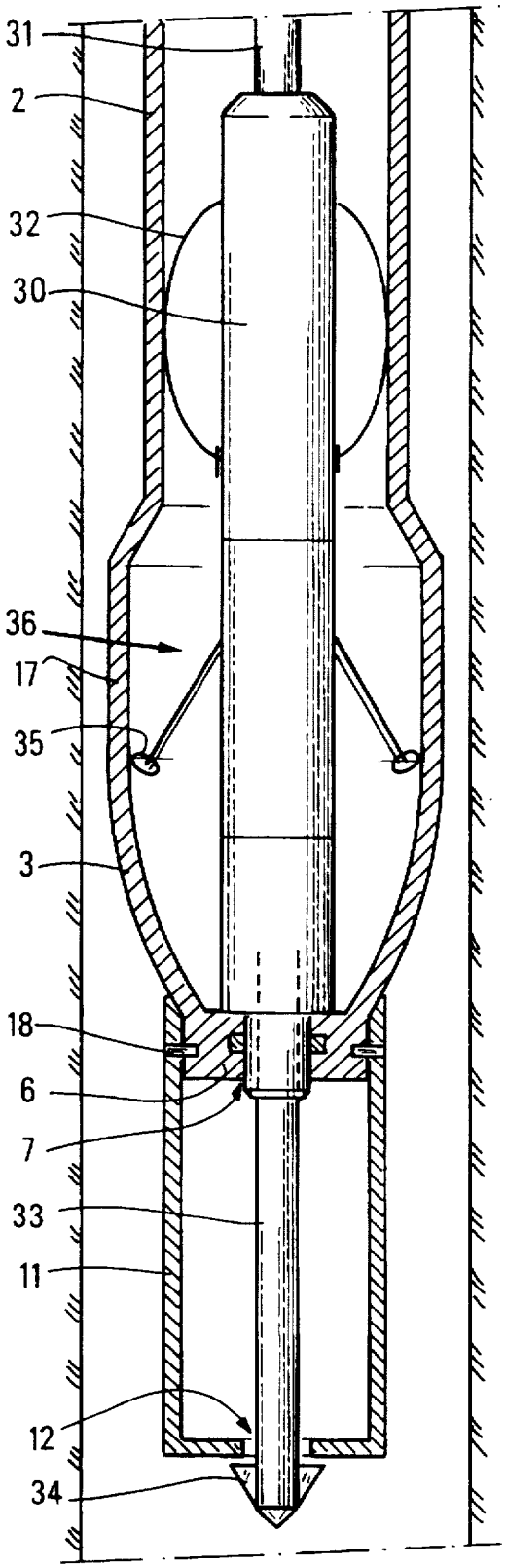
FIG. 4A shows the principle of the means for disconnecting the lower seal means.
Figure 4B:
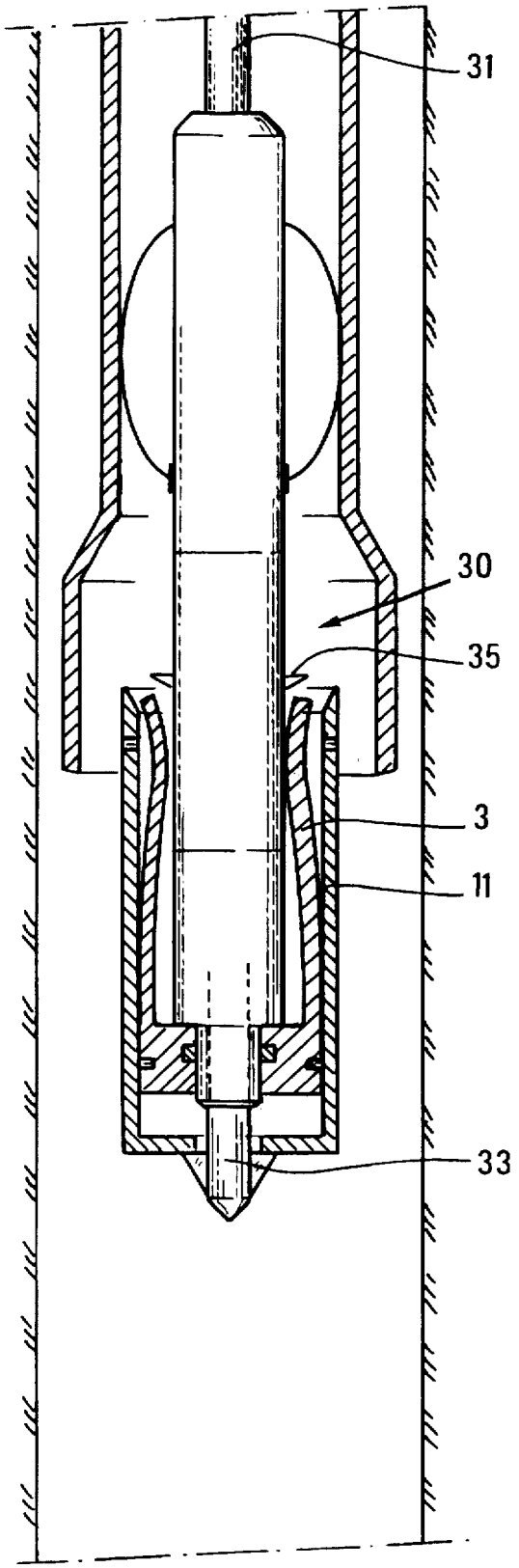
FIG. 4B shows the function of the receptacle according to the invention.

FIGS. 4A and 4B show the working principles and the means specific to the disconnection of the lower seal means.

In FIG. 4A, disconnecting means 30 are lowered into the inner space of casing 2 with the aid of operating means 31, for example, rods, tubing, coil tubing, an electro-hydraulic umbilical, an electric cable. Means 30 are positioned precisely with respect to seal means 3 by resting on seat 6 and possibly by means of centralizers 32. A rod 33 forms the extension of means 30 by running through the orifice 7 of means 3 and through the opening 12 of receptacle 11. Fingers 34 latch rod 33 on the receptacle. Cutting means 35 are borne by arms, retracted when means 30 are lowered in order to be installed, expanded when disconnecting means 30 are operated. Bringing into rotation of the part 36 bearing the cutting means causes part 3 to be disconnected from casing 2.

Several variants can be achieved:

the rotation of the cutting means is performed by the rotation of rods 31 from the surface, means 30 comprise a (hydraulic or electric) motorization for driving part 36 into rotation, the power required to activate the motorization being supplied through means 31 (electric cable, umbilical, . . . ).

In order to work, means 30 comprise means for controlling the spreading of cutting arms 35. These means are not shown in FIGS. 4A and 4B. The disconnecting means 30 according to the invention also comprise translation means for shifting rod 33 (not shown in FIGS. 4A and 4B) after the total cutting of seal means 3. The working principle of these translation means is shown in FIG. 4B.

In FIG. 4B, rod 33 has been run into the body of means 30 so as to raise receptacle 11 around the seal means 3 disconnected from casing 2. Thus, the receptacle acts as a sheath for seal means 3. Since the outside diameter of receptacle 11 is substantially smaller than the inside dimension of casing 2, receptacle 11, disconnecting means 30 can be taken up to the ground surface by operating means 31, whatever they may be.

In FIGS. 4A and 4B, the lower end 17 of casing 2 is widened, which constitutes a non limitative variant.

Figure 5A:
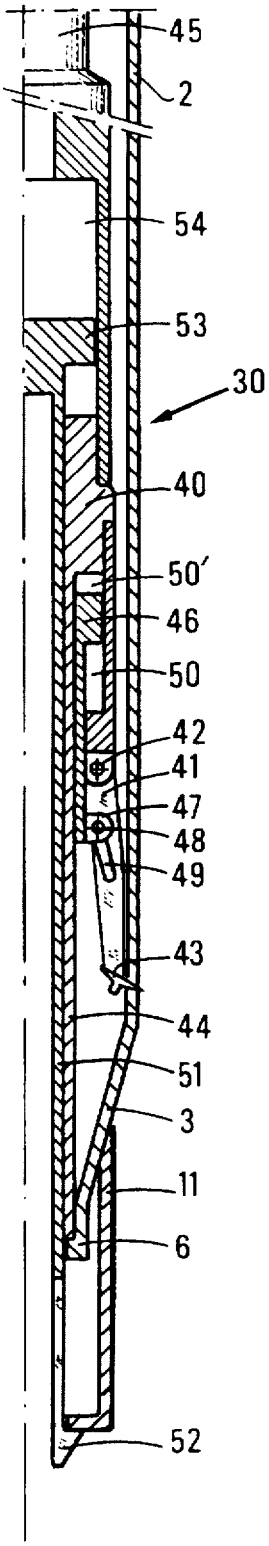
FIGS. 5A and 5B illustrate an embodiment of the invention.
Figure 5B:
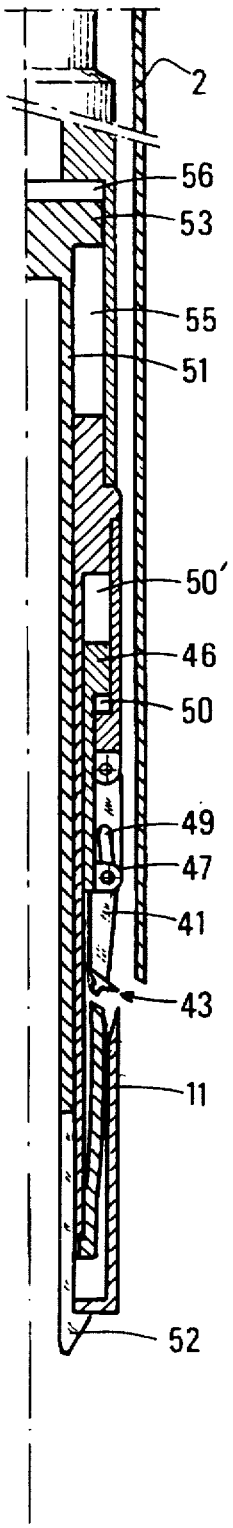

FIGS. 5A and 5B illustrate a variant of the disconnecting means that are hydraulically activated. Disconnecting means 30 comprise a main body 40 lowered at the end of a pipe 45. A lower extension 44 of body 40 rests and is centred on the seat 6 of the lower seal means 3 of casing 2. Cutting tools 43 are borne by arms 41 articulated at 42 on body 40. A part 46 bearing a piston is linked to each arm by stay bolts 47 having a pin 48 that runs through a slot 49 provided in arm 41, so that a hydraulic pressure in chamber 50 displacing part 46 has the effect of spreading arms 41 radially.

A rod 51 linked to a piston 53 can be hydraulically shifted radially in the liner 54 of body 40. This rod 51 bears, at the end thereof, locking means 52 that fit below receptacle 11 when the rod comes out of the receptacle. Any well-known means can be used, for example dog stop type retractable fingers.

FIG. 5B shows the disconnecting means once the seal means have been cut from the casing and the receptacle in position, ready for means 30 to be taken up.

The disconnecting means work as follows:

Means 30 are lowered into casing 2 by manoeuvring pipe 45, part 46 being locked so that the arms cannot spread during lowering. Locking can be achieved by means of a shear pin or by maintaining a hydraulic pressure in chamber 50' opposite chamber 50. Rod 51 has preferably been run into body 40 so as not to be damaged during lowering.

Once body 40 is blocked by seat 6, a hydraulic pressure in chamber 56 has the effect of moving out rod 51 and of latching its end 52 on receptacle 11.

A hydraulic pressure in chamber 50 has the effect of spreading the cutting arms.

The rotation of tubes 45 actuates cutting tools 43.

Once seal means 3 are disconnected from casing 2 (which can be seen from the surface by applying a given weight onto seat 6, this weight, taken up by rods 45 after cutting, can be observed from the surface), a hydraulic pressure is applied in chamber 55, possibly at the same time in chamber 50', so as to run rod 51 into the body in order to cause receptacle 11 to pass over seal means 3. Arms 41 are kept on body 40 in order to prevent casing 2 from being damaged during pulling.

The assembly is taken up by manoeuvring pipe 45.

The details of the hydraulic lines and of the possible distribution of the hydraulic pressure are not shown here since they are understandable to the engineer. It is clear that the hydraulic action can come from one or more sources, preferably through the pressure of a fluid in pipes 45 or by means of a multiconduit. Hydraulic distribution means can be placed in means 30 in order to deliver the pressurized fluid conveyed through pipe 45 into the various chambers described above. These distribution means can be remote-controlled by any well-known means, or by valves responding to pressure thresholds.

Figure 6A:
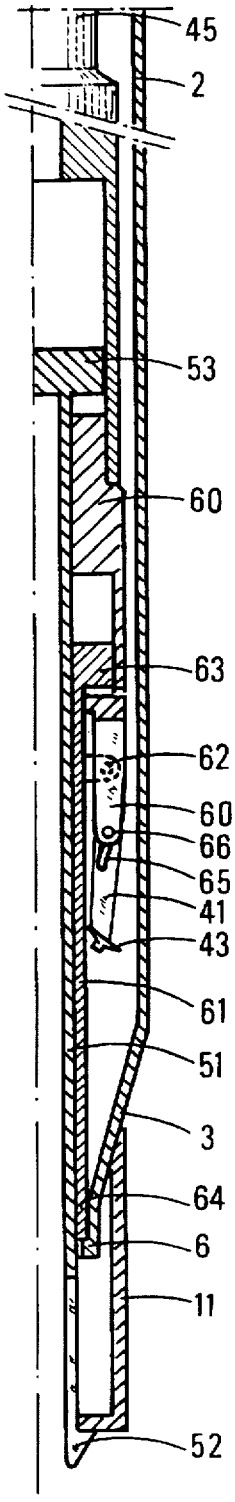
FIGS. 6A and 6B illustrate another variant of the invention.
Figure 6B:
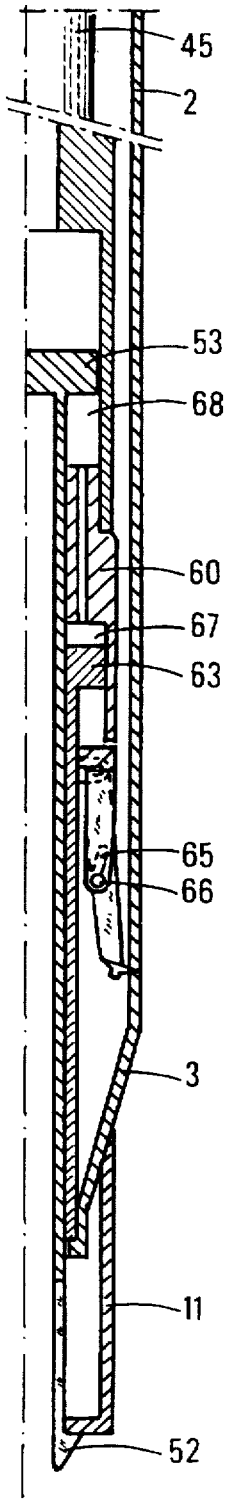

FIGS. 6A and 6B illustrate another variant of the disconnecting means in which the cutting means are spread and pressed against the wall of the lower seal means by the action of an axial force provided by a weight placed on seat 6.

The disconnecting means comprise a body 60 lowered into the casing through a pipe 45. An extension 61 can slide in translation with respect to body 60. Extension 61 comprises, at the ends thereof, a piston 63 on one side and a part 64 co-operating with seat 6 on the other side. The extension also comprises the articulated link 62 of arms 41 bearing the cutting tools 43. A slot 65 is provided in each arm 41 so that the pin 66 linked to body 60 causes arms 41 to spread when body 60 moves towards the dog, extension 61 being stopped by said dog. This relative displacement between parts 60 and 61 is controlled at the surface by means of tubes 45.

As in the variant of FIGS. 5A and 5B, a rod 51 runs through the opening of seat 6 so as to be locked below receptacle 11 by means of dog stops or equivalents. The displacement of rod 51 is performed by means of a piston 53. Application of a hydraulic pressure in chamber 68 has the effect of running rod 51 into body 60 while driving receptacle 11 that covers then seal means 3. Application of a hydraulic pressure in chamber 67 has the effect of shifting body 60 with respect to extension 61 in the direction of closing of the cutting arms. Chambers 67 and 68 preferably communicate hydraulically.

I claim:

1. A method for casing a well (1) from a tubular preform (2) that is radially deformable by inflation between a folded state in which its greatest transverse dimension is smaller than the diameter of the well and another, unfolded state in which said preform has a substantially cylindrical shape, said preform comprising upper and lower ends, upper and lower seal means (3, 4) at opposite ends of the tubular preform, the preform being hardenable in the well so as to constitute said casing, said method comprising:

inserting into the inner space of the preform, means (30) for disconnecting said seal means (3) situated at the lower end of the preform, raising said seal means to the surface after placing the seal in a receptacle (11) whose transverse dimension is smaller than the inside diameter of the preform once hardened.

2. A method as claimed in claim 1, wherein said upper said receptacle (11) is fastened to said lower seal means (3).

3. A method as claimed in claim 1, wherein seal means (4) are first disconnected from the upper end of the preform once the latter has hardened.

4. A method as claimed in claim 1, wherein said disconnecting means (30) are lowered into said preform (2) by means of rods (31).

5. A method as claimed in claim 4, wherein said disconnecting means (30) are activated through the rotation of the rods in the rods.

6. A method as claimed in claim 4, wherein said disconnecting means (30) is activated by a pressurized fluid contained in the rods.

7. A device for casing a well (1) from a tubular preform (2) having upper and lower ends and a selected inside diameter radially deformable by inflation between a folded state in which its greatest transverse dimension is smaller than the diameter of the well and another, unfolded state in which said preform has a substantially cylindrical shape, said preform comprising seal mean (3, 4) at both ends, the preform being hardenable in the well so as to constitute said casing, said device being characterized in that it comprises means (30) for disconnecting said lower seal means (3), a receptacle (11) in which said lower seal means (3) are placed after disconnection, said receptacle having a transverse dimension smaller than the inside diameter of the preform once hardened.

8. A device as claimed in claim 7, wherein said receptacle is fastened to the end of said lower seal means and said lower seal means define a seat (6) and an orifice (7).

9. A device as claimed in claim 8, wherein a measuring assembly (8) is fastened to the lower seal means with the aid of said seat (6), said assembly said sealing orifice (7).

10. A device as claimed in claim 9, wherein said measuring assembly (8) is connected to the ground surface by conductors (22) incorporated in the preform.

11. A device as claimed in claim 8, wherein said disconnecting means (30) comprise a rod (33; 51) that runs through said orifice (7) so as to latch said receptacle (11), cutting means (35) positioned with respect to the lower seal means with the aid of of said seat, said cutting means being activated through at least one of the following actions: rotation, compression on the disconnecting means, pressure of a fluid.

12. A device as claimed in claim 10, wherein measuring assembly (8) comprises detectors suited for locating the lower end of the preform in the well.

13. A device as claimed in claim 8, wherein the disconnecting means comprise means for delivering a pressurized fluid.

* * * * *